US005185187A

United States Patent [19]

Yashiki et al.

[11] Patent Number: 5,185,187

[45] Date of Patent: Feb. 9, 1993

[54] METHOD AND APPARATUS FOR DIP COATING A HOLLOW CYLINDRICAL BODY

[75] Inventors: Yuichi Yashiki; Hiroaki Moriyama; Kazuaki Aoki, all of Kanagawa, Japan

[73] Assignee: Fuji Xerox Co., Ltd., Tokyo, Japan

[21] Appl. No.: 726,168

[22] Filed: Jul. 2, 1991

Related U.S. Application Data

[63] Continuation of Ser. No. 272,284, Nov. 17, 1988, abandoned.

[30] Foreign Application Priority Data

Jun. 2, 1987 [JP] Japan ..... 62-137784
Aug. 27, 1987 [JP] Japan ..... 62-211324

[51] Int. Cl.[5] ..... B05D 1/18; B05C 3/02; B05C 11/11

[52] U.S. Cl. ..... 427/430.1; 118/406; 118/425; 118/504

[58] Field of Search ..... 427/430.1; 118/406, 118/425, 504

[56] References Cited

U.S. PATENT DOCUMENTS 1,217,071 2/1917 Rust ..... 118/425
2,739,911 3/1956 Andriulis et al. ..... 118/406
4,620,996 11/1986 Yashiki ..... 427/430.1

FOREIGN PATENT DOCUMENTS 57-5047 1/1982 Japan ..... 427/430.1
58-186472 10/1983 Japan .
59-4467 1/1984 Japan .
59-142869 8/1984 Japan .
59-169567 9/1984 Japan ..... 118/406
60-132678 7/1985 Japan .
62-241578 10/1987 Japan .
63-192046 8/1988 Japan ..... 427/430.1

OTHER PUBLICATIONS english abstract for Japanese Abstract 59-142869 to Yuuichi Yashiki, Aug. 1984.

*Primary Examiner*—Shrive Beck
*Assistant Examiner*—Katherine A. Bareford
*Attorney, Agent, or Firm*—Finnegan, Henderson, Farabow, Garrett and Dunner

[57] ABSTRACT

The present invention provides an apparatus and a method for forming a uniform and smooth coating film on a surface of a cylindrical body, for example, for production of an electrophotographic photosensitive body. The apparatus of the present invention includes a float having a space portion formed in the inside thereof for floatation in the liquid surface of the paint. The float is specifically formed so that even in the case where the paint contains a solvent that gradually evaporates, no bubbles are generated from a lower portion of a hollow cylindrical body during the coating step, because the pressure rising inside the hollow cylindrical body is moderated by the space portion of the float.

9 Claims, 4 Drawing Sheets

METHOD AND APPARATUS FOR DIP COATING A HOLLOW CYLINDRICAL BODY

This application is a continuation under 37 C.F.R. § 1.62 of U.S. patent application Ser. No. 07/272,284, filed Nov. 17, 1988, now abandoned.

FIELD OF THE INVENTION

The present invention relates to a method and apparatus for dip coating a hollow cylindrical body for localizing paint on the outer surface of the hollow cylindrical body.

BACKGROUND OF THE INVENTION

There are many conventional methods for coating the outside surface of a cylindrical body with paint. Conventionally, where the smoothness of a coating film is of particular importance, a dip coating method has been used.

Generally, dip coating methods are employed to apply paint to a cylindrical body by dipping the cylindrical body into the paint and pulling the cylindrical body out of the paint at a particular speed The problem however, is that this method often times does not properly localize the paint on the outer surface of the cylindrical body. Rather, if the cylindrical body is opened at the upper and lower ends paint oftentimes enters the interior of the cylindrical body, thus coating paint not only on the outer surface but also the inner surface of the cylindrical body. Because the inner surface of a cylindrical body is coated with paint, paint is wasted and the inner surface of the cylindrical body does not properly dry and thus has the propensity to become contaminated.

In an effort to solve the aforementioned problems, a method has been suggested wherein a cover is attached to a lower portion of a cylindrical body to prevent paint from adhering to the inner surface of the cylindrical body. Specifically, Japanese Patent Unexamined Publication No. 59-142869 employs this suggested method.

Another conventional method, disclosed in Japanese Patent Unexamined Publication No. 58-186472, requires closing an upper portion of the cylindrical body. The problem with this method is that it necessitates bringing a thin inner pressure-detecting tube into the cylindrical body. Moreover, the method presents a problem because it requires additional devices such as a pressure sensor, a solenoid valve, and an electric circuit for controlling the pressure sensor and the solenoid valve.

In the coating method disclosed in Japanese Patent Unexamined Publication Nos. 59-4467 and 60-132678, a valve acting as the pressure adjustment mechanism is attached to the upper portion blocking device. When the cylindrical body is pulled out of the paint, the valve is immediately opened to adjust the air pressure in the cylindrical body prior to the liquid surface of the paint that has entered the cylindrical body reaches the lower end of the cylindrical body. This method is difficult because it involves precisely timing the adjustment for opening the valve at the point where the cylindrical body is pulled out of the paint. Moreover, this method cannot be applied to a cylindrical body which includes a closed upper portion and thus its use is limited to certain types of cylindrical bodies.

The pressure in a cylindrical body changes depending on the kind of solvent and the specific weather conditions it is subjected to, such as temperature and humidity. Accordingly, in the methods disclosed in the aforementioned Japanese Patent Unexamined Publications, it is difficult to achieve a pressure adjustment capable of modifying the pressure-adjustment conditions in accordance with various coating conditions. Further, because heretofore pressure-adjustment mechanisms have required a large number of moveable parts, dip coating apparatus has been complex and frequently has required excessive maintenance work.

In an effort to solve the problems outlined above, a method has been disclosed, for example-, in Japanese Patent Application No. 84743/61, wherein a space portion is formed in an upper portion of the cylindrical body to moderate the rising air pressure due to solvent evaporation. Typically, the space portion is closed but communicates with the inside of a cylindrical body. FIG. 5 shows the prior art method wherein a hollow cylindrical body 1 is held by a pillar supporting member 4, a grasping member 3, an 0-ring 5, and a cylindrical supporting member 2. A space portion S is formed in the cylindrical support member 2 and located at the top portion of the hollow cylindrical body for carrying out a pressure moderation function. The reference numerals 6 and 7 designate a coating tank and paint respectively. The difficulty with this method is it cannot be applied to a cylindrical body having a closed upper portion. Further, another problem with this method is that the supporting members are complicated in construction.

SUMMARY OF THE INVENTION

An object of the present invention is to overcome the problems and disadvantages of the prior art.

Another object of the present invention is a dip coating method for localizing the application of a dip coating, such as paint, on the outer surface of a hollow cylindrical body having a closed upper end.

Another object of the present invention is a dip coating method wherein bubbles are prevented from generating when the hollow cylindrical body is pulled out of the coating tank.

Another object of the present invention is a dip coating method that may be employed in a simple manner using merely a float in the liquid surface of the paint.

A further object of the present invention is an apparatus for dip coating a hollow cylindrical body formed of few parts and requiring infrequent maintenance that is capable of localizing the application of paint on the outer surface of the hollow cylindrical body.

A further object of the present invention is a dip coating apparatus free of complicated pressure adjustment mechanisms and inexpensive to utilize.

To achieve the objects and in accordance with the purpose of the present invention, as embodied and broadly herein, the dip coating method and apparatus of the present invention utilizes a hollow cylindrical body having an interior, exterior, inner diameter, outer diameter, closed upper end and an open lower end. The hollow cylindrical body is connected to a pillar supporting means that is connected to a lifting member. The lifting member is connected to a screw for effecting vertical movement of the hollow cylindrical body into a coating tank. A float having an outer diameter smaller than the inner diameter of the cylindrical body is floated on the liquid surface of the paint. Subsequently, the hollow cylindrical body is vertically dipped into the paint so as to make the float enter the inside of the hollow cylindrical body. Further, the float includes a space portion formed on the inside thereof configured to float on a liquid surface of the paint such that the larger area of the space portion is located under the liquid level of the paint.

BRIEF DESCRIPTION OF THE DRAWINGS

The accompanying drawings, which are incorporated in and constitute a part of this specification, illustrate several embodiments of the present invention and together with the description, serve to explain the principles of the present invention.

DETAILED DESCRIPTION OF THE PREFERRED EMBODIMENTS

Figure 1:
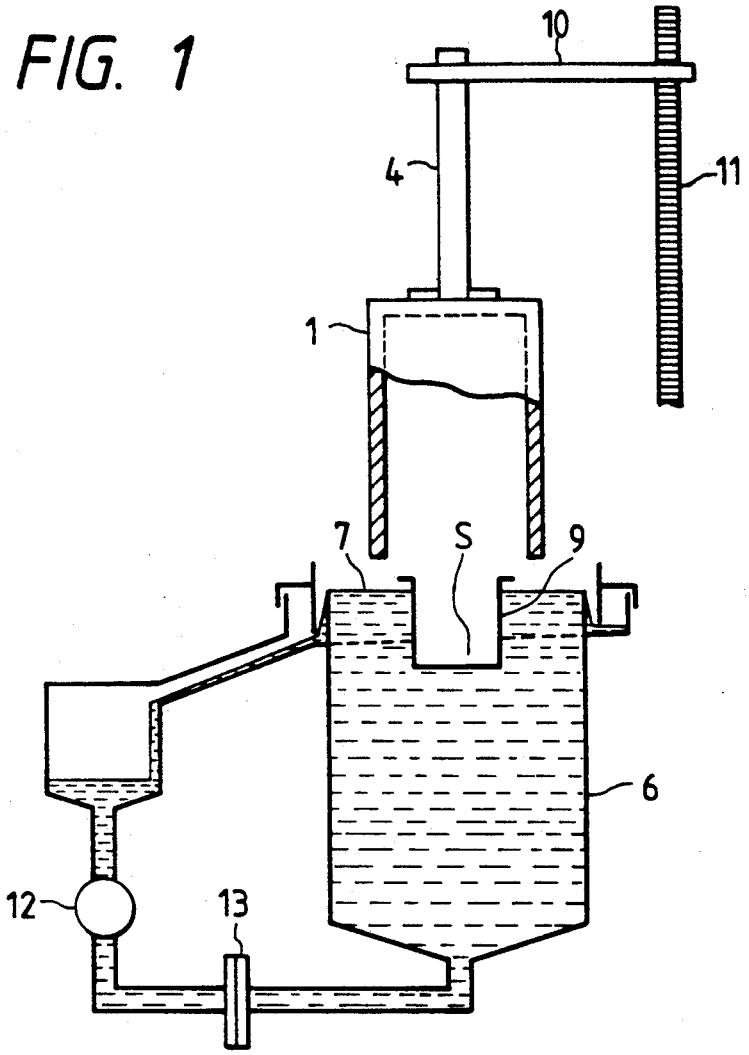
FIG. 1 is a sectional view of the dip coating apparatus of the first embodiment of the present invention.

FIG. 1 shows a sectional view of the first embodiment of the dip coating apparatus used of the present invention. The hollow cylindrical body 1 to be coated has a closed upper portion. The upper portion of the hollow cylindrical body 1 is attached to a pillar supporting member 4. As a result, the hollow cylindrical body 1 can be vertically moved with the pillar supporting member 4 by means of a lifting member 10 and a screw 11. In the case where hollow cylindrical body 1 having open ends is used, the upper end is first closed and then attached to the pillar supporting member 4. Further, a coating tank 6 filled with paint 7 is provided. The paint 7 circulates by means of a paint circulation device including a pump 12 for pushing the paint through a filter 13. The paint circulation device may be omitted if it is not necessary. A cylindrical float 9, having a space portion S formed therein, is floated below the liquid surface level of the paint 7. The cylindrical float 9 has an outer diameter smaller than the inner diameter of the hollow cylindrical body 1 so that the cylindrical float 9 can freely move in and out of the interior of the hollow cylindrical body 1. Preferably, the outer diameter of the cylindrical float 9 is made as large as possible, but is within the range wherein the cylindrical float 9 may freely move in and out of the interior of the cylindrical body 1. To effectively prevent evaporation of a solvent of the paint 7, it is preferred that the cylindrical float 9 be shaped such that when the cylindrical float 9 is floated in the paint 7 the maximum outer diameter portion of the cylindrical float 9 is located above the liquid surface level of the paint 7.

To increase the volume of air enclosed inside the hollow cylindrical body 1 the space portion S of the cylindrical float 9 is provided. Thus, the cylindrical float 9 must be formed so as to enable the greater part of the space portion S to be located under the liquid surface level of the paint 7 when floating. The volume of the space portion S is optimally selected at a specific value such that when the hollow cylindrical body 1 is coated the paint 7 does not excessively enter the interior of the hollow cylindrical body 1 and bubbles are prevented from generating. However, if the volume of the space portion S is too large when the hollow cylindrical body 1 is dipped into the paint 7 the bottom portion of the cylindrical float 9 will contact the coating tank 6. It is necessary to select the volume of the space portion S so that the float 9 will not contact the bottom of the coating tank 6 when the hollow cylindrical body 1 is dipped into the paint 7.

Figure 2:
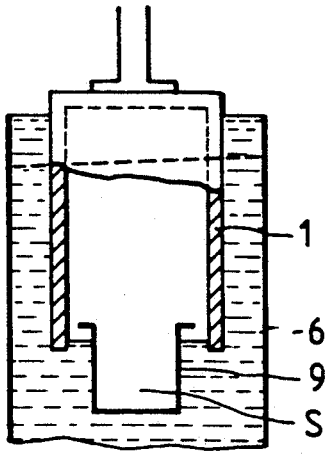
FIG. 2 is a view illustrating the coating step of the first embodiment of the coating method of the present invention.

The cylindrical body 1 is dipped into the paint 7 as the the cylindrical float 9 enters the hollow cylindrical body 1. FIG. 2 shows the state in which the hollow cylindrical body 1 has been dipped to the lowermost portion of the paint. If the cylindrical body 1 is pulled out from the state shown in FIG. 2, a coating film forms on an outer surface of the hollow cylindrical body 1.

In the step shown in FIG. 2, a small quantity of paint has entered the inside the lower portion of the hollow cylindrical body 1. It is the inner pressure applied to the paint 7 which causes the paint 7 to slightly enter the interior of the hollow cylindrical body 1. As a result, the completed hollow cylindrical body 1 is slightly coated with the paint on the interior surface of its end portion. This however, does not cause any problems.

Figure 3:
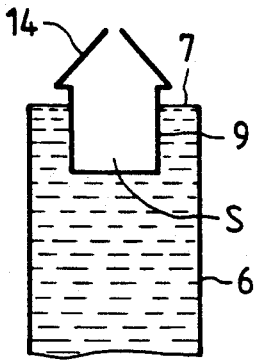
FIGS. 3 and 4 are sectional views of the float used in the first embodiment of coating method of the present invention.

As shown in FIG. 3, preferably a wedge-shaped inclination is provided on the upper portion of cylindrical float 9 so that the float 9 can successfully enter the hollow cylindrical body 1. In FIG. 3, a conically-shaped portion 14 is formed at the upper portion of the cylindrical float 9. A through hole is formed in a portion of the conically-shaped portion 14 for ventilation purposes.

Figure 4:
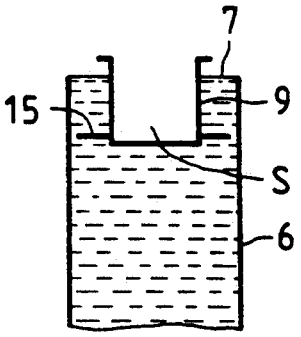
Figure 5:
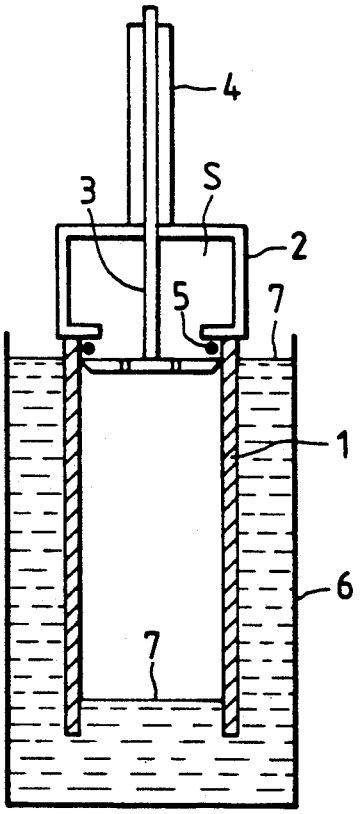
FIG. 5 PRIOR ART
FIG. 5 is a view of a prior art dip coating apparatus.

As shown in FIG. 4, the cylindrical float 9 may be provided with leg portions 15 to prevent the cylindrical float 9 from sliding in the liquid surface of paint 7 to the inside periphery of the coating tank 6.

Materials may be used to form the cylindrical float 9 that possess sufficient durability against the paint solvent and allow the majority of the space portion S, formed in the cylindrical float 9, to be positioned under the liquid level surface of paint 7 when the cylindrical float 9 is floated in the liquid surface of the paint. For example, the cylindrical float 9 may be formed from a metal such as aluminum, stainless steel, brass, copper, tin plate, galvanized iron, or a plastic material such as polyethylene, polypropylene and polychloroethylene. As shown in FIG. 4, leg portions 15 are provided on the cylindrical float 9 and may be formed from a plate material such as wire, or the like.

If the hollow cylindrical body 1 is dipped into the paint 7, as shown in FIG. 2, the cylindrical float 9 enters the interior of the hollow cylindrical body 1 such that paint 7 is contained in a small gap between the outer circumference of the float 9 and the inner circumference of the hollow cylindrical body 1. The remainder of the interior of the hollow cylindrical body 1 is covered with the float 9. As a result, the small gap represents a small narrow area thus diminishing the amount of paint 7 solvent that can evaporate. Further, the evaporation speed of the solvent is exremely low. Even if the solvent evaporates slightly the space portion S, formed in the cylindrical float 9, moderates the rising air pressure rising in the cylindrical body 1 to diminish the pressure rising phenomenon inside the hollow cylindrical body 1.

Consequently, the aforementioned disadvantages of the conventional dip coating methods are eliminated, that is, the air pressure rising inside the hollow cylindrical body 1 due to the evaporation of the solvent of the paint can be prevented such that upon removal of the hollow cylindrical body 1 from the paint 7 the air inside the cylindrical body 1 is prevented from coming of the hollow cylindrical body 1 in the form of bubbles.

The method of dip coating of the present invention was applied to form a substrate for an electrophotographic photosensitive body as follows. The-cylindrical body 1, was formed of an aluminum pipe having an outer diameter of 84 mm, an inner diameter of 82 mm, and a length of 310 mm. The paint was prepared using 8 weight portions of a copolymer of nylon resin (tradename: CM 8000, made by TORAY INDUSTRIES, INC.) dissolved in 55 weight portion of methanol and 40 weight portions of butanol. Methanol was used because it is a solvent which is easy to evaporate, its vapor pressure being about 100 mmHg at 20° C.

The prepared paint was poured into the dip coating apparatus of FIG. 1. A float, having a shape as shown in FIG. 4, was formed of 0.5 mm thick brass. The float utilized possessed a maximum outer diameter of 70 mm, an inner diameter of 69 mm. The depth of the cylindrical body was 60 mm, and the height of the maximum outer diameter portion from the liquid level was 20 mm. The float was provided with three leg portions, formed of wire located at the bottom portion of the float, so that the outer diameter of the leg portions were smaller by 2 mm than the inner diameter of the coating tank.

The cylindrical body was dipped into the paint at a speed of 800 mm/min to float the float in the liquid surface of the paint, and pulled out of the paint at a speed of 80 mm/min. No bubbles were generated during the pulling out of the cylindrical body. Subsequently, the cylindrical body was dried at 100° C. for 5 minutes thereby forming a uniform substrate having a thickness of 1.0 μm.

When coating was performed using the same steps as above and the cylindrical body wa pulled out by a distance of about 180 mm, bubbles were generated from the lower portion of the cylindrical body. The bubbles burst open in the liquid surface thereby disturbing the liquid surface. As a result, considerable unevenness was generated in film thickness.

Figure 6:
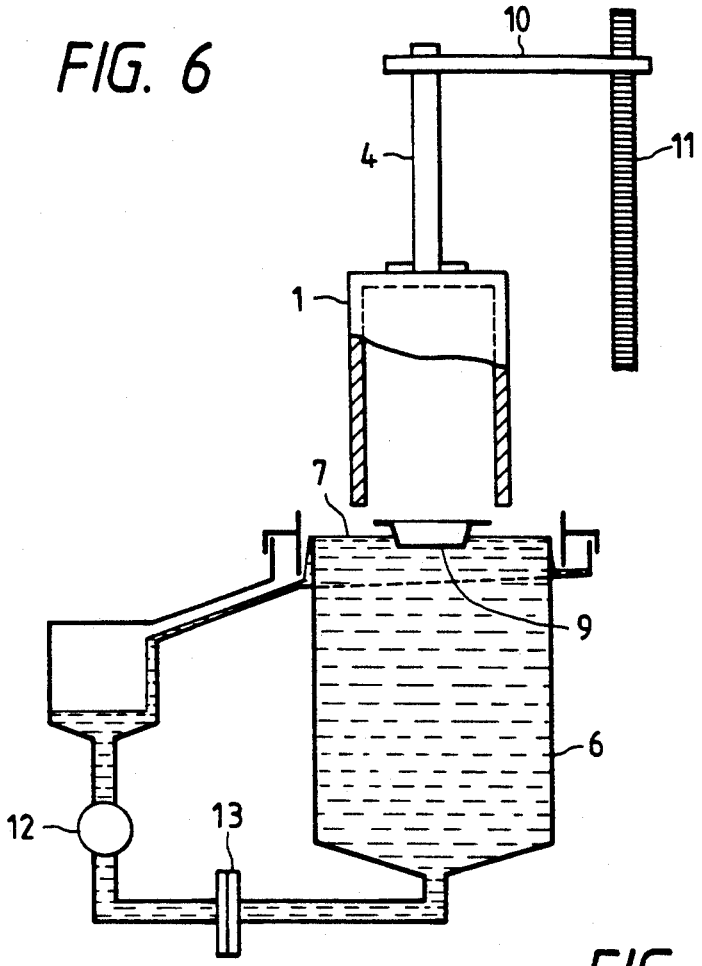
FIG. 6 is a schematic view of the dip coating apparatus of the second embodiment of the present invention.

As shown in FIG. 6, a float 6 was utilized that lacked a space portion in the inside thereof. The float 9 possessed a maximum diameter of 70 mm and the height of the maximum outer diameter portion from the liquid level was 20 mm. The float 9 was formed of 0.5 mm thick aluminum. When this prepared float 9 was used and the cylindrical body 1 was pulled out a distance of about 250 mm, bubbles were generated from the lower portion of the cylindrical body.

The present invention has the novel feature of a float 9 having a space portion formed in the inside thereof, being floated in the liquid surface of the paint at the time when the greater part of the space portion is located under the liquid level of the paint. Therefore, even in the case where the paint contains a solvent that gradually evaporates, no bubbles are generated from a lower portion of a cylindrical body 1 during the coating step because the pressure rising inside the cylindrical body 1 is moderated by the space portion of the float 9. As a result, the coating film generated is of a good quality with no defects.

Accordingly, the present invention represents an exceedingly suitable technique for forming a uniform and smooth coating film on a surface of a cylindrical body, for example, for production of an electrophotographic photosensitive body. The dip coating method according to the present invention has the advantage that because dip coating can be performed in an extremely simple manner having only a float floated in the liquid surface of paint, it is not necessary to provide the conventional complicated mechanism for pressure adjustment and incidental facilities. Moreover, maintenance and inspection may be readily carried out and coating may be inexpensively performed.

Figure 7:
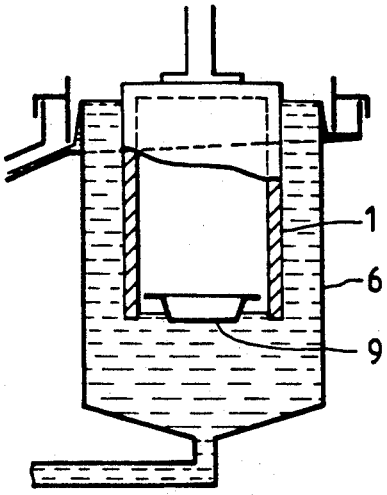
FIGS. 7 and 8 illustrate the coating step of the second embodiment of the coating method of the present invention; and, FIGS. 9, 10, 11, 12 and 13 are sectional views of the float used in the coating method of the present invention.
Figure 8:
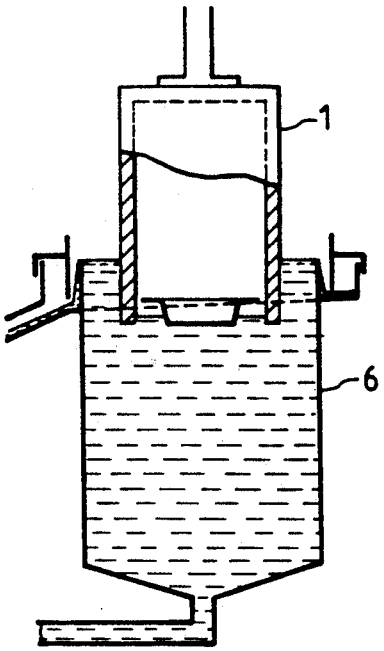

FIG. 6 shows a sectional view of the second embodiment of dip coating apparatus of the present invention. A hollow cylindrical body 1 having a closed upper portion is attached to a pillar supporting member 4 so that the cylindrical body can be vertically moved with the pillar supporting member 4. A coating tank 6 is filled with paint 7 that is circulated by a pump 12 through a filter 13. A float 9 is floated on the liquid surface of the paint 7. The float 9 has an outer diameter that is smaller than the inner diameter of the hollow cylindrical body 1 so that the float 9 can freely move in and out of the interior of the hollow cylindrical body 1. It is desirable that the outer diameter of the float 9 be made as large as possible, but is within the range wherein the float 9 may freely move in and out of the interior of the cylindrical body 1. As the hollow cylindrical body 1 is dipped into the paint 7, the float 9 is received into the hollow cylindrical body 1. FIG. 7 shows the state wherein the hollow cylindrical body 1 has been dipped to the portion in the paint. If the hollow cylindrical body 1 is pulled up from the state of FIG. 7, a coating film is formed on an outer surface of the hollow cylindrical body 1. FIG. 8 shows the state where a coating film has been formed on the outer surface of the hollow cylindrical body 1 by pulling out the hollow cylindrical body 1.

At the state shown in FIG. 7, a small quantity of paint has entered the interior of the lower portion of the hollow cylindrical body 1. This is caused by the inner pressure of the paint 7. Consequently, the finished hollow cylindrical body 1 is coated with paint 7 at a small area located on the inside surface end portion of the hollow cylindrical body 1. However, this does not cause any difficulty.

Figure 9:
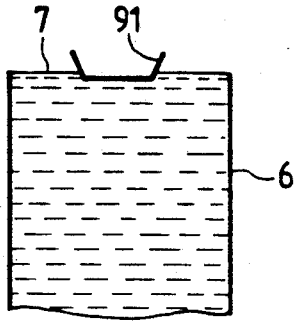
Figure 10:
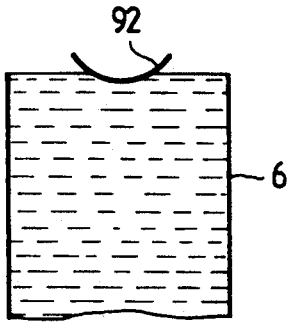

The float of the present invention is not particularly limited in shape and may have any shape as long as the float has a maximum outer diameter portion which is as large as possible, but is within the range where the float can freely move in and out of the interior of the hollow cylindrical body and can float in the liquid surface of the paint. In order to effectively prevent evaporation of a solvent in the paint, its is preferable that the float be shaped so that its maximum outer diameter portion is located above the liquid level of the paint while the float is floated in the liquid surface of the paint. Such a float appears, for example, in FIGS. 9 and 10 depicting a dish-like float and a bowl-like float having a weight at its bottom portion, respectively.

Figure 11:
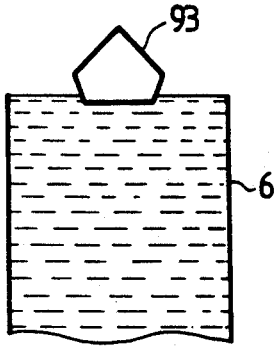
Figure 12:
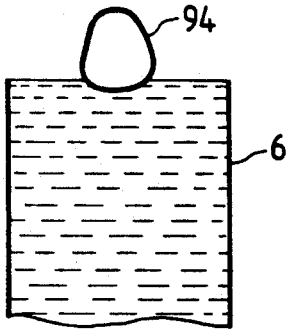
Figure 13:
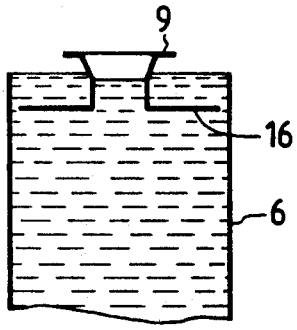

Further, preferably the float has at its upper portion a wedge-like inclination to readily allow the float to enter the interior of the hollow cylindrical body. Examples of such a float are illustrated in FIGS. 11 and 12. FIG. 11 shows a float 93 having a conical top portion, and FIG. 12 shows an oval float 94 having a weight at its bottom portion. The top portion of the float 94 may be closed and a hole may be formed at the top portion. Each of the floats of FIGS. 6 through 12 may be provided with leg portions 16, as shown in FIG. 13 to prevent the float from moving in the liquid surface of the paint to the inside periphery of the coating tank 6.

Materials may be used to form the float that possess sufficient durability against the paint solvent. For example, the float may be formed of metal such as aluminum, stainless steel, brass, copper, tin plate, galvanized iron, or a plastic material such as polyethylene, polypropylene and polychloroethylene. Where leg portions 16 are provided they may be formed of a plate material such as wire, or the like.

If the hollow cylindrical body 1 is dipped into the paint 7, as shown in FIG. 7, the float 9 enters the interior of the hollow cylindrical body 1, such that the liquid surface of the paint 7 is located in a small gap between the outer circumference of the float 9 and the inner circumference of the cylindrical body 1. The remainder of the interior of the cylindrical body 1 is covered with the float 9. Consequently, the gap represents a small narrow area of the liquid-surface from where the paint solvent can evaporate. Thus, the evaporation speed of the solvent is extremely low. As a result, the phenomenon where the air pressure inside the hollow cylindrical body 1 rises due to evaporation of the solvent barely occurs. Consequently, the aforementioned disadvantages of conventional dip coating is eliminated, that is, the air pressure rising inside the hollow cylindrical body 1 due to the evaporation of the solvent of the paint 7 is prevented. Upon pulling the hollow cylindrical body 1 out of the paint 7, air inside the hollow cylindrical body 1 may be prevented from exiting the hollow cylindrical body 1 in the form of bubbles.

The present invention may be applied to the formation of a substrate of an electrophotographic photosensitive body. A cylindrical body was formed of an aluminum pipe having an outer diameter of 84 mm, an inner diameter of 82 mm, and a length of 310 mm. The paint used was prepared using weight portions of copolymer of nylon resin (tradename: CM 8000, made by TORAY INDUSTRIES, INC.) dissolved in 60 weight portions of methanol and 40 weight portions of butanol. Methanol was used as a solvent because it is easy to evaporate as its vapor pressure is about 100 mmHg at 20° C.

The above prepared paint was poured into the dip coating apparatus of FIG. 6. A float, having a shape as shown in FIG. 13, was formed of 0.5 mm thick aluminum having a maximum outer diameter of 70 mm and the height of the maximum outer diameter portion being 20 mm form the liquid level. The float was provided with three leg portions, formed of wire and located at the bottom portion of the float, such that the outer diameter of the leg portions were smaller than the inner diameter of the coating tank by 2 mm.

At the state where the float was being floated on the liquid surface of the paint, the cylindrical body was dipped into the paint at a speed of 800 mm/min. Subsequently, the cylindrical body was pulled out of the paint at a speed of 100 mm/min. No bubbles were generated during the pulling out of cylindrical body. After being pulled out, the cylindrical body was dried at 100° C. for 5 minutes thereby forming a substrate having a thickness of 1.0 μm.

A float, having the shape shown in FIG. 12, was prepared using a polyethylene material and formed so that the float had a maximum outer diameter of 80 mm. Further, the height of the maximum outer diameter portion was 30 mm from the liquid level when the float was floated, and the total length was 90 mm. When coating was performed by using the float in the same manner as in the example above, the generation of bubbles was prevented. In this case, since the float could enter the interior of the cylindrical body and suitably roll, leg portions were not required.

For comparison, coating was performed with no float through the same steps as in the previous example. When the cylindrical body was pulled out by a distance of about 200 mm, bubbles were generated from the lower portion of the cylindrical body and burst open in the liquid surface. As a result, the liquid surface was disturbed such that considerable unevenness in film thickness was generated.

By using the dip coating method according to the present invention, when a coating film is formed only on the outer surface of a hollow cylindrical body, having a closed upper end and an open lower end, no bubbles are generated from the lower portion of the hollow cylindrical body in the coating step. Consequently, the coating film formed is of a good quality with no defect. Accordingly, the present invention is an exceedingly suitable technique for forming a uniform and smooth coating film on a surface of a hollow cylindrical body. The present invention may be used, for example, to produce an electrophotographic photosensitive body. Further, the dip coating method according to the present invention possesses the advantage that because dip coating can be performed by a simple means with a single float in the liquid surface of paint, it is not necessary to provide the conventional complicated mechanism for pressure adjustment and the incidental facilities. Moreover, maintenance and inspection may be readily carried out. Finally, the present invention makes it possible to inexpensively coat a hollow cylindrical body.

Other embodiments of the present invention will be apparent to those skilled in the art from consideration of the specification and practice of the disclosed invention. It is intended that the specification and examples be considered as exemplary only, with the true scope and spirit of the invention being represented by the following claims.

What is claimed is:

1. A dip coating method for forming a coating layer on the exterior of a hollow cylindrical body, wherein the hollow cylindrical body has an interior portion and includes a closed upper end and an open lower end which is vertically dipped into a liquid having a surface located in a coating tank, said method comprising:

forming a float;

floating said float on the surface of the liquid; and dipping the hollow cylindrical body vertically into the liquid so that the float enters entirely into the interior portion of the hollow cylindrical body and a limited amount of the liquid enters the interior portion of the lower end of the hollow cylindrical body.

2. The dip coating method for forming a coating layer on the exterior of a hollow cylindrical body according to claim 1, said method further comprising:

predetermining the specific configuration of said float to achieve a spaced portion therein of a suitable volume for preventing said float from contacting said bottom surface of said coating tank and limiting excessive entry of liquid in the interior of the hollow cylindrical body.

3. The dip coating method for forming a coating layer on the exterior of a hollow cylindrical body according to claim 1, said method further comprising:

upon dipping, forming a small gap between the surface of the inner diameter of the hollow cylindrical body and the surface of the outer diameter of the float for regulating the air pressure in the interior of said hollow cylindrical body to prevent the generation of bubbles.

4. A dip coating apparatus for applying a liquid to an exterior of a hollow cylindrical body having an interior with diameter D and including a closed upper end and an open lower end, comprising:

a coating tank having a bottom surface and an inner periphery adapted for containing the liquid;

a pillar supporting means having first and second ends, said first end being connectable to said closed upper end of the hollow cylindrical body and said second end being connected to a connecting member that is attached to a screw for vertically moving the hollow cylindrical body relatively toward the coating tank;

a float having an outer diameter d, where $d<D$, freely positioned in said coating tank and adapted to float freely on the liquid in the coating tank and to slide entirely in and out of the interior of the hollow cylindrical body, said float containing a space portion open to an atmospheric gas and being slidable into the hollow cylindrical body such that the total volume of atmospheric gas available to the interior of the hollow cylindrical body is increased upon vertical motion of the hollow cylindrical body in the liquid in the coating tank.

5. The dip coating apparatus according to claim 4, wherein said float includes a space portion beneath a surface level of said liquid open to an atmosphere that forms an air pocket with the interior of the hollow cylindrical body upon vertical motion of the hollow cylindrical body in the coating tank to increase the total volume of liquid displaced during the vertical motion.

6. The dip coating apparatus according to claim 4 wherein said float is a substantially cylindrical body.

7. The dip coating apparatus according to claim 6 wherein said float further includes:

an upper portion having a first end and a second end, said first end forming an inclined surface with the second end, wherein an outer diameter of the second end is d which is greater than an outer diameter of the first end, and a lower portion having an open upper end connected to the second end of the upper portion and a closed lower end, wherein an outer diameter of the open upper end is less than d.

8. The dip coating apparatus according to claim 7 wherein said first end of the upper portion of said float is open to an atmospheric gas.

9. The dip coating apparatus according to claim 4, wherein said float includes a body portion and leg portions, wherein said leg portions prevent an outer surface of the body portion of the float from making contact with the inner periphery of the coating tank.

* * * * *